US007096768B1

(12) United States Patent
Chen

(10) Patent No.: US 7,096,768 B1
(45) Date of Patent: Aug. 29, 2006

(54) EXTENSION ROD ASSEMBLY

(76) Inventor: Hsiu E Chen, No. 238, Minsheng Rd., Daliao Township, Kaohsiung County (TW)

( * ) Notice: Subject to any disclaimer, the term of this patent is extended or adjusted under 35 U.S.C. 154(b) by 1 day.

(21) Appl. No.: 11/098,684

(22) Filed: Apr. 4, 2005

(51) Int. Cl.
*B25B 23/12* (2006.01)
*B25B 23/08* (2006.01)

(52) U.S. Cl. ..... 81/438; 81/451; 81/125

(58) Field of Classification Search ..... None
See application file for complete search history.

(56) References Cited

U.S. PATENT DOCUMENTS 5,724,873 A * 3/1998 Hillinger ..... 81/451
5,996,452 A * 12/1999 Chiang ..... 81/429
6,530,299 B1 * 3/2003 Liu ..... 81/451
6,973,858 B1 * 12/2005 Huang ..... 81/177.85

* cited by examiner

*Primary Examiner*—David B. Thomas
(74) *Attorney, Agent, or Firm*—Charles E. Baxley

(57) ABSTRACT

The present invention relates to an extension rod assembly for a screw driving tool, which includes a base, a slide sleeve, a rear compression spring, a front compression spring, a fixing ring and a magnetic iron. The rear and front compression springs are disposed in the slide sleeve. When pushing the slide sleeve toward the tool head, the magnetic iron at end of the slide sleeve can provide a magnetic force to make the tool head pick up a screw to be screwed easily, besides, when pushing the slide sleeve toward the rod, the tool head will be caused to slide out of the slide sleeve, so as to facilitate replacement of the tool head.

8 Claims, 8 Drawing Sheets

EXTENSION ROD ASSEMBLY

BACKGROUND OF THE INVENTION

1. Field of the Invention

The present invention relates to an extension rod assembly for a screw driving device, and more particularly to an extension rod assembly that has a wider application and can enable the tool head to be replaced more easily.

2. Description of the Prior Arts

An automatic screw driving tool is generally provided with an extension rod assembly, an end of the extension rod assembly is connected with a replaceable tool head, while another end of the extension rod assembly is clamped and rotated by the screw driving tool. The tool head connected to the extension rod assembly, in turn, will be rotated to tighten or loosen a screw. In operation, the extension rod can produce a magnetic force to pick up the screw automatically.

As shown in FIGS. 1 and 2, TW Patent 94103623 discloses an extension rod assembly comprises: a base 11, a slide sleeve 12, a spring 13, a fixing ring 14 and a magnetic iron 15. The base 11 is provided for insertion of a rod 111 and a tool head 112. The slide sleeve 12 is moveably mounted on the rod 11. The spring 13 is mounted on the rod 11 and biased between the shoulder 113 of the rod 11 and the slide sleeve 12. The fixing ring 14 is mounted on the rod 11. The magnetic iron 15 is disposed at an end of the slide sleeve 12 for passage of the tool head 112, so that the tool head 112 can pick up screw automatically.

In operation, however, this extension rod assembly still has the following disadvantages that need to be improved:

First, as can be seen in FIG. 2, the slide sleeve 12 is only able to move towards the tool head 112 but unable to move in the opposite direction (toward the rod 111), so if the tool head 112 only projects slightly out of the slide sleeve 12, then it will be a problem to pull the tool head 112 out of the slide sleeve 12 and replace it.

Second, although the replacement can be done by clamping the head of the tool head 112 with a clamping device, the clamping activity may cause damage to the tool head 112.

The present invention has arisen to mitigate and/or obviate the afore-described disadvantages.

SUMMARY OF THE INVENTION

The primary objective of the present invention is to provide an extension rod assembly for a screw driving device that has a wider application and can enable the tool head to be replaced more easily.

An extension rod assembly in accordance with the present invention comprises: a base, in either end of which are axially inserted a replaceable rod and a tool head, on an outer periphery of the base formed a shoulder; a slide sleeve is moveably mounted on the base and interiorly provided with an annular tube; a rear compression spring is mounted on the tool head and biased between the shoulder of the base and the annular tube; a front compression spring is mounted on the slide sleeve and biased between a fixing ring mounted on the slide sleeve and the shoulder of the base; and a magnetic iron is disposed at an end of the slide sleeve and provided for passage of the tool head.

The present invention will become more obvious from the following description when taken in connection with the accompanying drawings, which show, for purpose of illustrations only, the preferred embodiment in accordance with the present invention.

DETAILED DESCRIPTION OF THE PREFERRED EMBODIMENT

Figure 1:
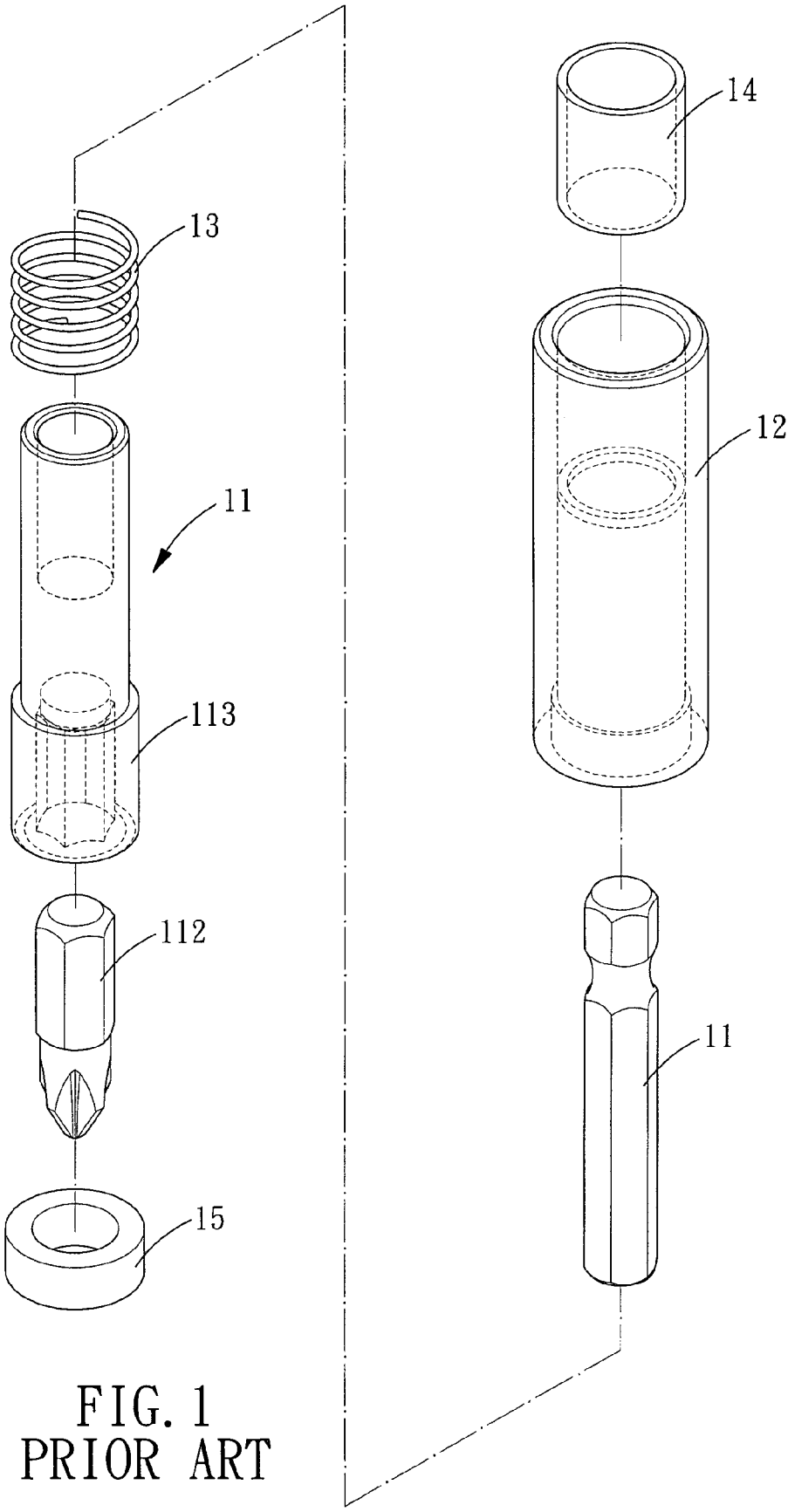
FIG. 1 PRIOR ART
FIG. 1 is an exploded view of a conventional extension rod assembly.
Figure 2:
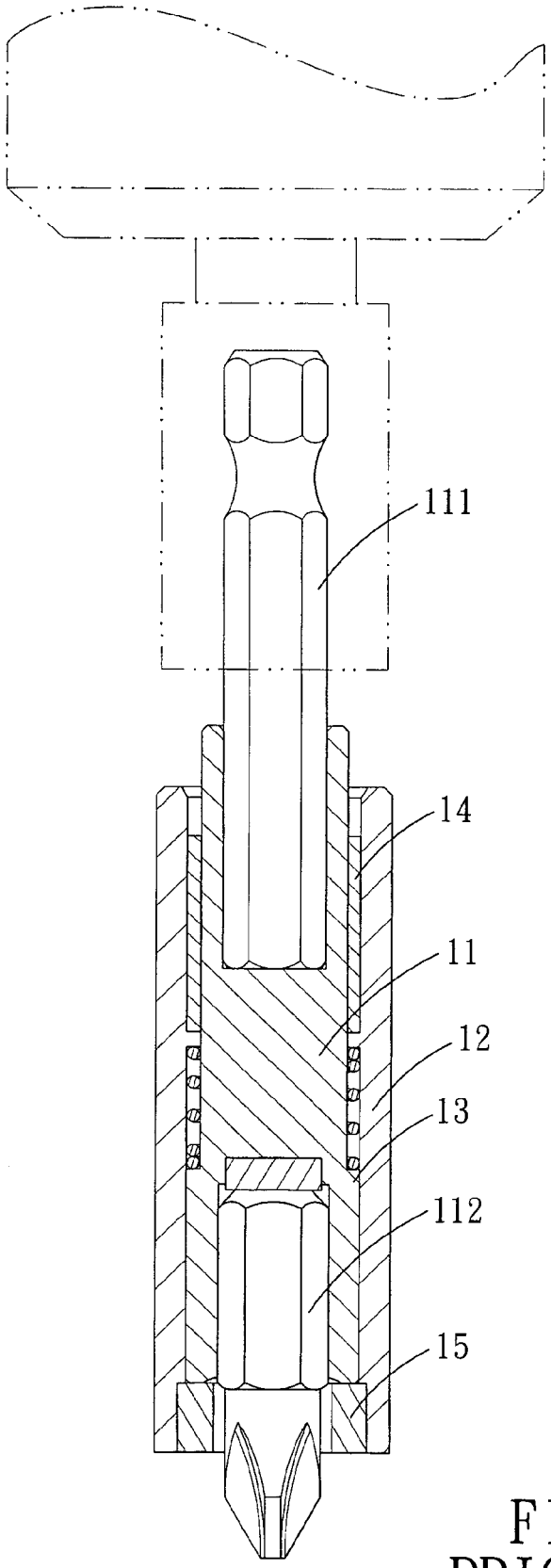
FIG. 2 PRIOR ART
FIG. 2 is a cross sectional view of the conventional extension rod assembly.
Figure 3:
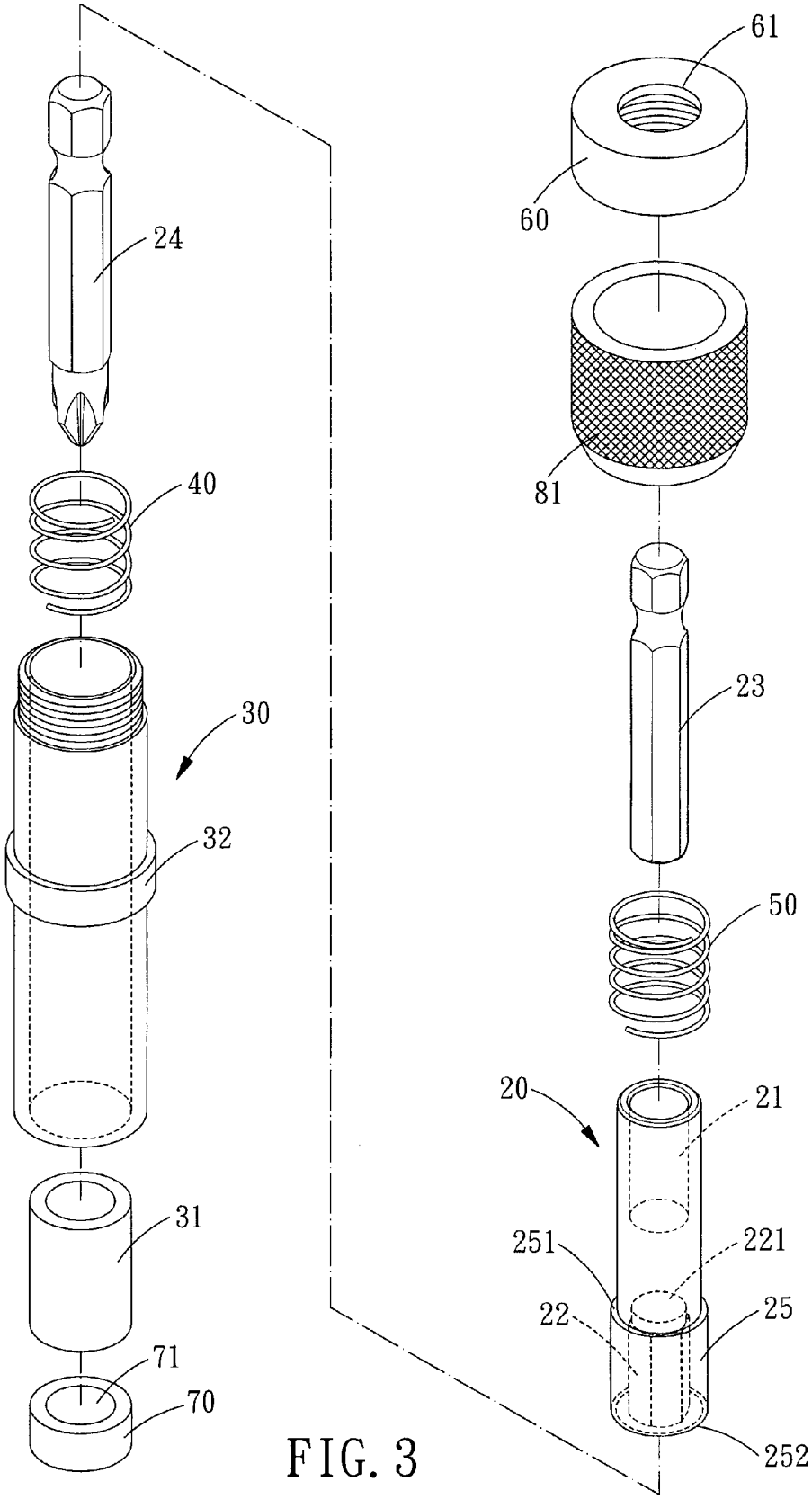
FIG. 3 is an exploded view of an extension rod assembly in accordance with the present invention.
Figure 4:
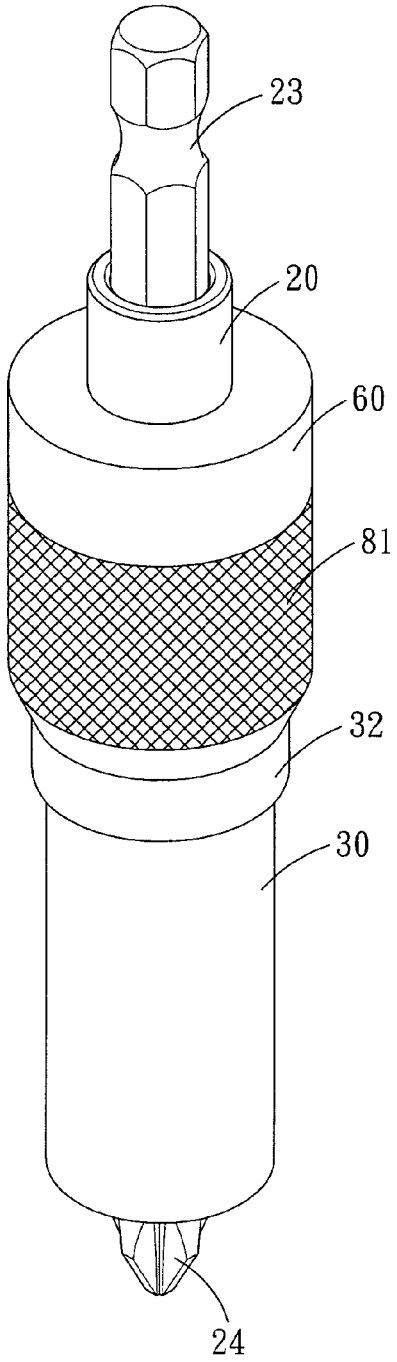
FIG. 4 is an assembly view of the extension rod assembly in accordance with the present invention.
Figure 5:
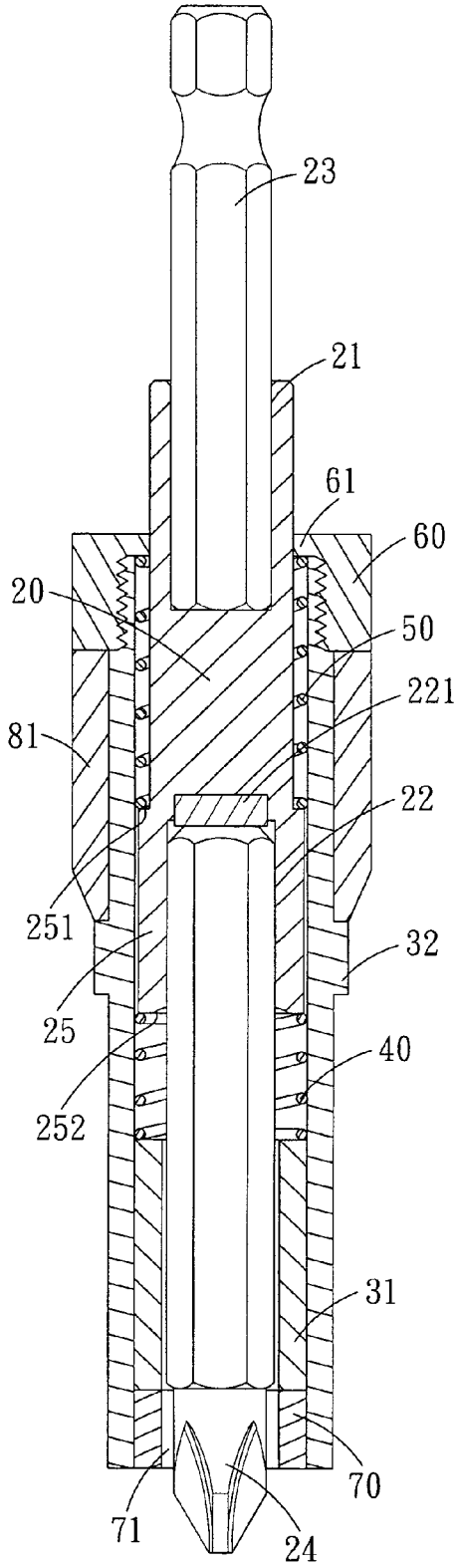
FIG. 5 is a cross sectional view of the extension rod assembly in accordance with the present invention.

Referring to FIGS. 3–5, an extension rod assembly in accordance with a preferred embodiment of the present invention is shown and comprises a base 20, a slide sleeve 30, a rear compression spring 40, a front compression spring 50, a fixing ring 60 and a magnetic iron 70.

At either end of the base 20 are axially formed a first recess 21 and a second recess 22 provided with a magnetic member 221. The first recess 21 is provided for insertion of a rod 23, while the second recess 21 is provided for accommodation of a tool head 24 employed to rotate screws or other objects of the like. A shoulder 25 is defined on the outer periphery of the base 20 and located adjacent to the end that the tool head 24 is to be inserted, the shoulder 25 includes a first abutting face 251 and a second abutting surface 252.

The slide sleeve 30 has a tubular shape and is interiorly provided with an annular tube 31, on the outer periphery of the slide sleeve 30 is defined an annular flange 32. The slide sleeve 30 is moveably mounted on the base 20. It is to be noted that the annular tube 31 can be directly formed in the slide sleeve 30 or can be inserted in the slide sleeve 30.

The rear compression spring 40 is mounted on the tool head 24 and located in the slide sleeve 30 and biased between the second abutting surface 252 of the shoulder 25 of the base 20 and the annular tube 31 of the slide sleeve 30.

The front compression spring 50 is mounted on the base 20 and an end of the front compression spring abuts against the first abutting surface 251 of the shoulder 25 of the base 20.

The fixing ring 60 is provided on the inner periphery thereof with an annular flange 61 and is screwed on the slide sleeve 30 in such a manner that the annular flange 61 pushes against another end of the front compression spring 50. It will be noted that between the annular flange 32 of the slide sleeve 30 and the fixing ring 60 is disposed an annular member 81.

The magnetic iron 70 is disposed at an end of the slide sleeve 30 and is defined a through hole 71 for allowing passage of the tool head 24, so that the magnetic iron 70 can make the tool head 24 pick up screws more easily.

Figure 6:
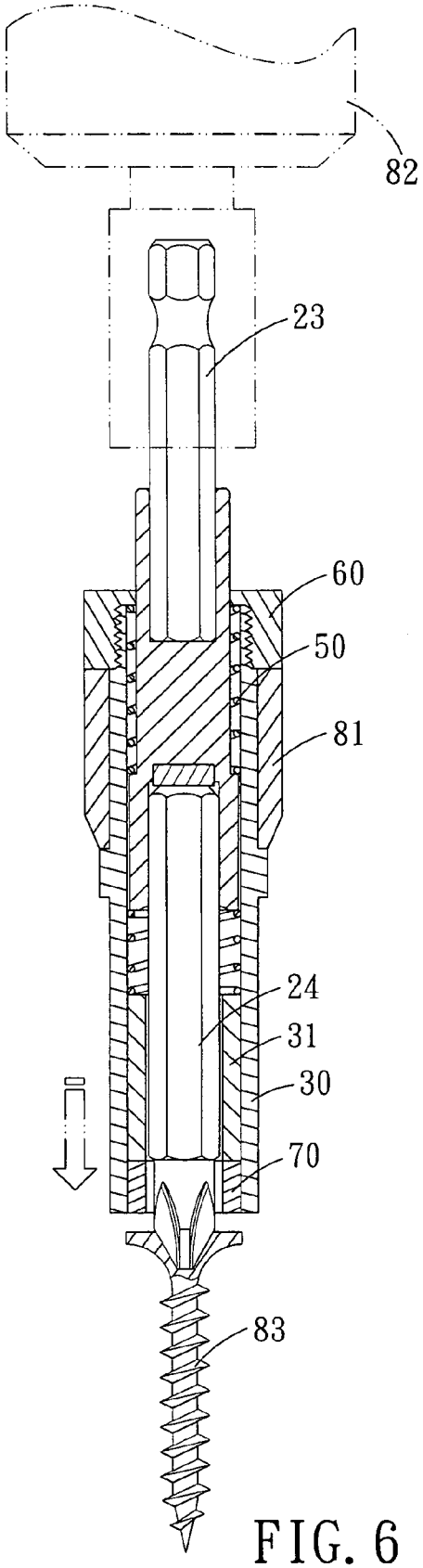
FIG. 6 is a cross sectional view of the extension rod assembly in accordance with the present invention before the screw is attracted to the magnetic iron.
Figure 7:
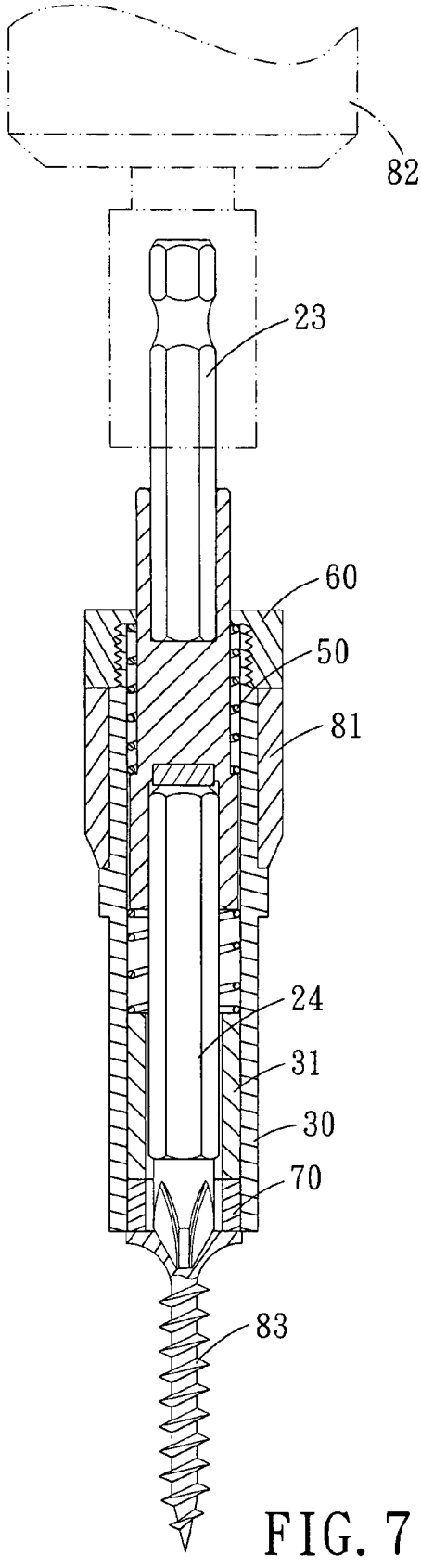
FIG. 7 is a cross sectional view of the extension rod assembly in accordance with the present invention after the screw is attracted to the magnetic iron.

For a better understanding of the present invention, its operation and function, references should be made to FIGS. 6 and 7. When the rod 23 is clamped on an electric screw driving tool 82 and the tool head 24 engages with a screw 83, the screw 83 will be attracted by the magnetic iron 70 at end of the slide sleeve 30, and in turn, the slide sleeve 30 will be cause to move toward the tool head 24 until the screw 83 is firmly attracted to the magnetic iron 70. Furthermore, the downward slide motion of the slide sleeve 30 will lengthen the front compression spring 50, therefore, after the screw 83 is driven away from the tool head 24, the compression spring 50 will draw the slide sleeve 30 back to its original position.

Figure 8:
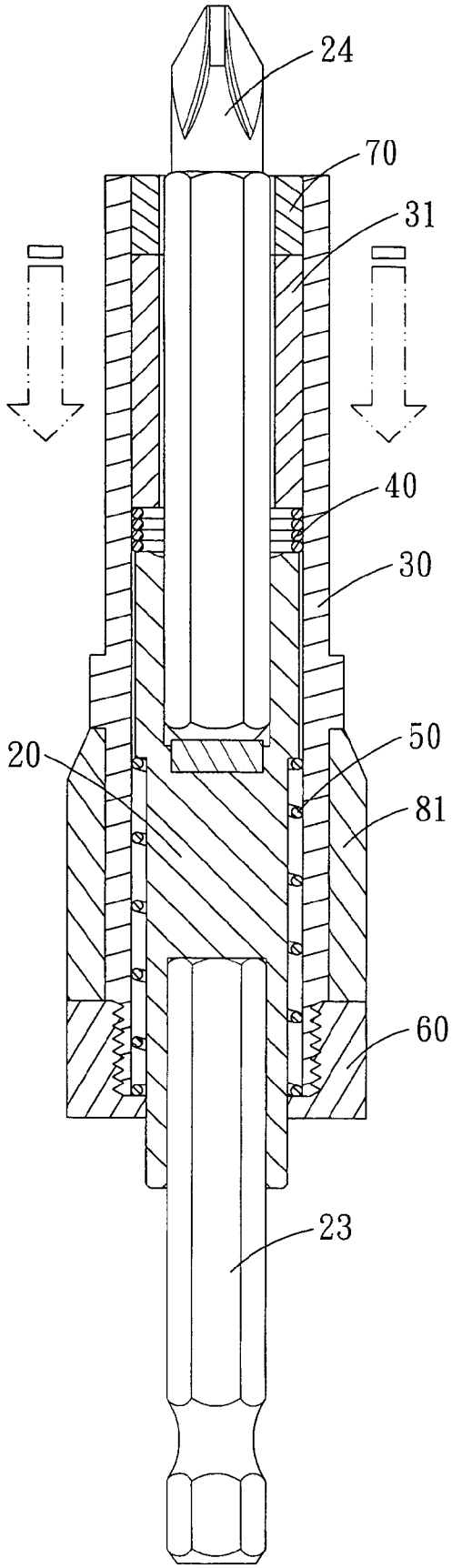
FIG. 8 is an illustrative view of showing how to replace the tool head, wherein the slide sleeve is being pushed toward the rod.
Figure 9:
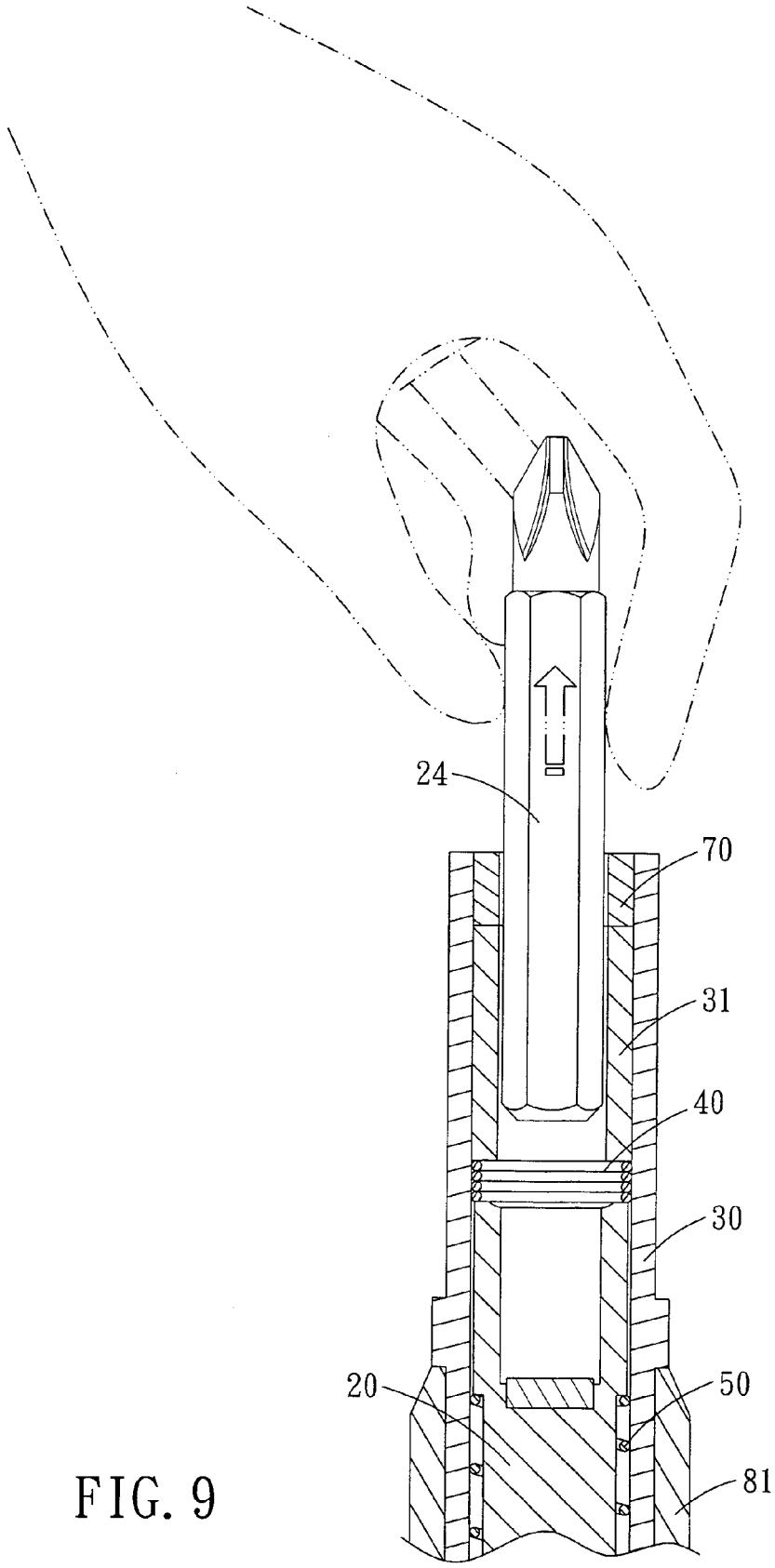
FIG. 9 is an illustrative view of showing how to replace the tool head, wherein the tool head is being pulled out of the slide sleeve.

Referring then to FIGS. 8 and 9, to replace the tool head 24, the user can hold the base 20 while pushing the slide sleeve 30 toward the rod 23 to press the rear compression spring 40, so as to reveal more of the tool head 24 out of the slide sleeve 30, and thus the tool head 24 can be pulled out of the slide sleeve 30 for easy replacement. After the replacement operation is over, the slide sleeve 30 will be pushed back to its original position by the rear compression spring 40.

Figure 10:
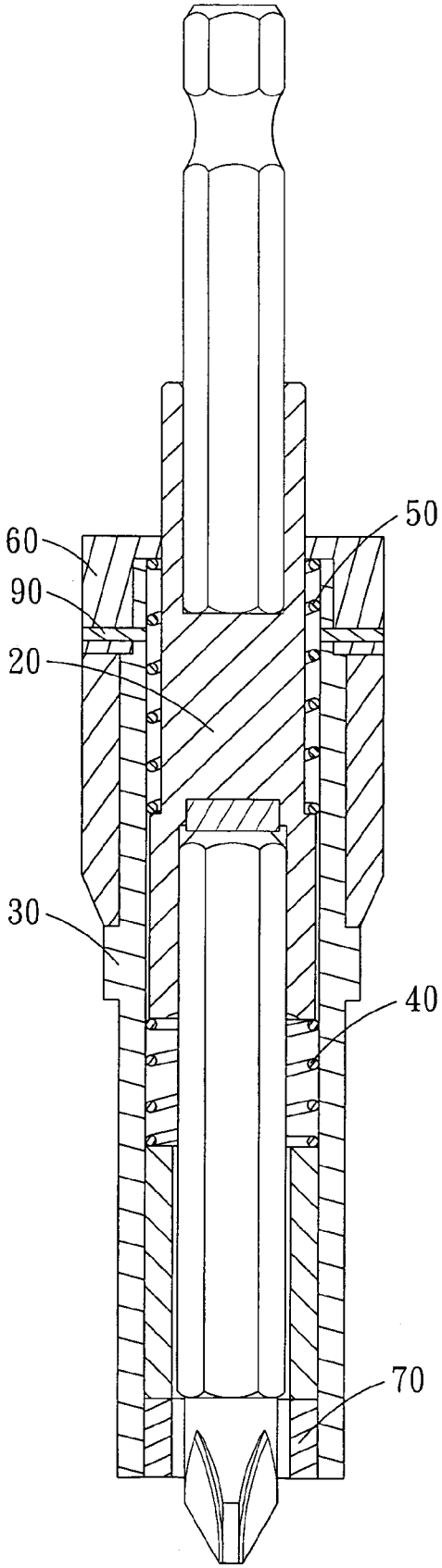
FIG. 10 shows another assembly manner between the fixing ring and the slide sleeve.

Referring finally to FIG. 10, the fixing ring 60 is fixed to the slide sleeve 30 by means of locking pins 90.

The front and rear compression springs 40, 50 in the slide sleeve, besides serving to positioning the base 20 in the slide sleeve 30, also can enable the base 20 to axially reciprocate within the slide sleeve 30, so as to facilitate the replacement of the tool head 24 and to pick up the screws more easily. Similarly, in the slide sleeve and on the base can be arranged magnetic irons, such that the base 20 also can be caused to axially reciprocate within the slide sleeve 30 by taking advantage of the characteristic of the magnetic iron that two like magnetic poles repel each other.

While we have shown and described various embodiments in accordance with the present invention, it should be clear to those skilled in the art that further embodiments may be made without departing from the scope of the present invention.

What is claimed is:

1. An extension rod assembly comprising:

a base, in either end of which being axially inserted a replaceable rod and a tool head, on an outer periphery of the base formed a shoulder;

a slide sleeve moveably mounted on the base and interiorly provided with an annular tube;

a rear compression spring mounted on the tool head and biased between the shoulder of the base and the annular tube;

a front compression spring mounted on the slide sleeve;

a fixing ring mounted on the slide sleeve, and the front compression spring biased between the shoulder of the base and the fixing ring;

a magnetic iron disposed at an end of the slide sleeve and provided for passage of the tool head; and so that when pushing the slide sleeve toward the tool head, the magnetic iron at end of the slide sleeve can provide a magnetic force to make the tool head pick up a screw to be screwed easily, besides, when pushing the slide sleeve toward the rod, the tool head will be caused to slide out of the slide sleeve, so as to facilitate replacement of the tool head.

2. The extension rod assembly as claimed in claim 1, wherein a recess is formed at either end of the base of the extension rod assembly for insertion of the rod and the tool head, respectively.

3. The extension rod assembly as claimed in claim 2, wherein a magnetic member is disposed in the recess where the tool head is received.

4. The extension rod assembly as claimed in claim 1, wherein the shoulder includes a first abutting surface and a second abutting surface for resting of the front compression spring and the rear compression spring.

5. The extension rod assembly as claimed in claim 1, wherein the fixing ring is formed with an annular flange for resting of another end of the front compression spring.

6. The extension rod assembly as claimed in claim 1, wherein an flange is formed on outer periphery of the slide sleeve, between the flange of the slide sleeve and the fixing ring is disposed an annular member.

7. The extension rod assembly as claimed in claim 1, wherein the fixing ring is screwed on the slide sleeve.

8. The extension rod assembly as claimed in claim 1, wherein the fixing ring is fixed on the slide sleeve by means of locking pins.

* * * * *